US006191374B1

(12) United States Patent
Schulze

(10) Patent No.: US 6,191,374 B1
(45) Date of Patent: Feb. 20, 2001

(54) SELF-ADJUSTING CONTACT LEVER

(75) Inventor: Claus-Peter Schulze, Neumünster (DE)

(73) Assignee: General Electric Company, Schenectady, NY (US)

( * ) Notice: Under 35 U.S.C. 154(b), the term of this patent shall be extended for 0 days.

(21) Appl. No.: 09/158,381

(22) Filed: Sep. 22, 1998

(30) Foreign Application Priority Data

Sep. 23, 1997 (DE) ..... 197 41 927

(51) Int. Cl.[7] ..... H01H 1/22
(52) U.S. Cl. ..... 200/244; 200/248
(58) Field of Search ..... 200/240, 241, 200/242, 244, 248

(56) References Cited

U.S. PATENT DOCUMENTS

| | | | | |
|---|---|---|---|---|
| 3,061,702 | | 10/1962 | Jencks . | |
| 3,286,067 | * | 11/1966 | Menickella et al. | 200/244 X |
| 4,649,247 | | 3/1987 | Pruess et al. | 200/244 |
| 4,650,935 | * | 3/1987 | Ootsuka et al. | 200/240 X |
| 6,064,017 | * | 5/2000 | Schulze | 200/244 |

FOREIGN PATENT DOCUMENTS 502394 9/1992 (EP) .

* cited by examiner

*Primary Examiner*—Renee Luebke
(74) *Attorney, Agent, or Firm*—Carl B. Horton; Robert V. Donahoe

(57) ABSTRACT

The invention pertains to a contact lever for an electrical switch designed for automatic adjustment of the main contacts. During assembly the pivot shaft is inserted in an oblong opening in the contact lever. The switch position is changed from open to closed by rotating the contact lever on the pivot shaft. The pivot shaft includes two conically extending shoulders that correspond in shape to chamfers located at the edge of the oblong opening. The conical shoulders and chamfers comprise a portion of the bearing surface between the contact lever and the pivot shaft. A sliding bearing pair is formed during switch operation wherein the contact lever is limited to a centrally aligned position in the open position and allowed additional freedom of motion at the end of the closing operation. The additional freedom of motion allows for precise automatic contact alignment.

10 Claims, 3 Drawing Sheets

SELF-ADJUSTING CONTACT LEVER

FIELD OF THE INVENTION

The invention pertains to a switch, in particular, a power switch or a high-speed d.c. circuit breaker. The invention further pertains to automatically maximizing contact alignment.

DISCLOSURE OF THE INVENTION

Conventional switches contain a contact lever that is arranged on a stationary shaft by means of an oblong hole in the contact lever. In the open state as well as during a pivoting motion of the contact lever in order to close the switch, the shaft is accommodated in a cylindrical end section of the oblong hole which acts as a sliding bearing. After the switch is closed, i.e., after the contact lever is pivoted to such a degree that the main contacts contact one another, the pivoting motion is continued by a short distance such that the contact lever is lifted off said end section in the oblong hole and disengaged from the bearing seat. Due to this subsequent pivoting of the contact lever, the surfaces of the main contacts which contact one another are partially adjusted relative to one another.

The invention is based on the objective of developing a switch, in which the position of the main contact surfaces can be optimally and automatically adjusted relative to one another in order to realize maximum contact alignment.

For the solution to the objective with the claims taken into account, two conditions must be fulfilled in order to achieve an optimal actuation of the switch or a flawless switching process. First, the contact lever that carries one main contact needs to be positioned exactly in the center relative to the second main contact while the contact lever is still in the open position so as to centrally contact the second main contact when the switch is closed. Second, the first main contact carried by the contact lever might need an additional adjustment into a precise position relative to the second main contact when the switch is in the closed position.

The aforementioned conditions are optimally fulfilled with the switch according to the invention. One end section of the oblong hole is realized in such a way that it ensures a large-surface sliding surface between the contact lever and the shaft without any play while the switch is still in the open position, i.e., the main contact situated on the contact lever can be brought into contact with the second main contact in an exactly central fashion. In addition, an opening section situated adjacent to the aforementioned end section which carries the contact lever on the shaft after the circuit is closed due to the subsequent pivoting of the contact lever is realized in such a way that the contact lever is able to simultaneously carry out two pivoting motions in different directions. Consequently, the first main contact carried by the contact lever can be adjusted into a precise position referred to the second main contact similar to a ball joint after the circuit is closed.

Advantageous additional developments of the invention are particularly pointed out in the appended claims.

The invention is described in detail below with reference to two embodiments that are illustrated in the figures.

DETAILED DESCRIPTION OF THE PREFERRED EMBODIMENTS OF THE INVENTION

Figure 1B:
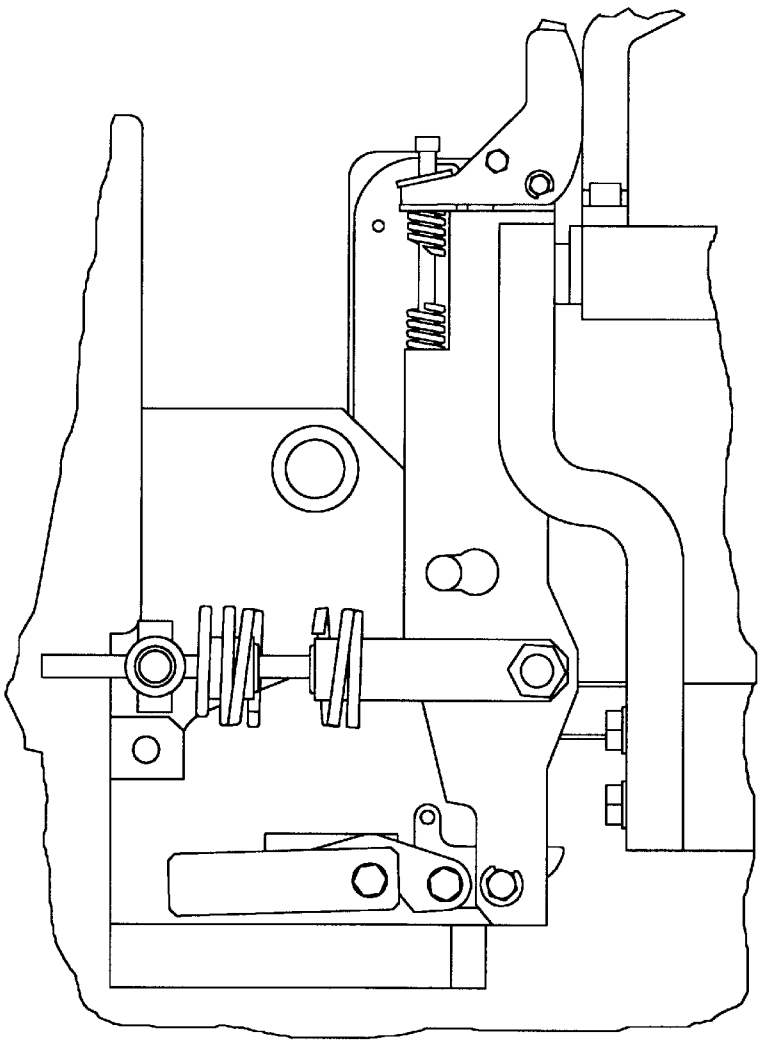
FIGS. 1*a*, 1*b*, a side view of the switch in the open (FIG. 1*a*) state and in the closed (FIG. 1*b*) state.
Figure 1A:
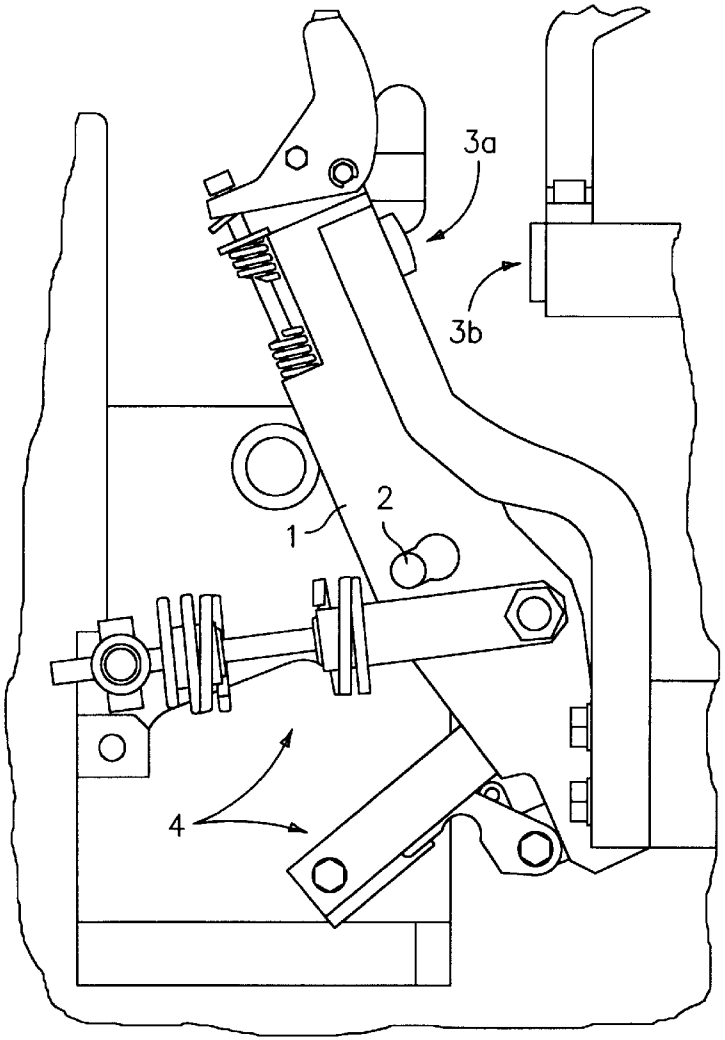

FIGS. 1*a* and 1*b* show that the switch according to the invention is equipped with a contact lever 1 that can be pivoted essentially parallel to the plane of projection about an axis 2 in order to mutually contact the main contacts 3*a* and 3*b* of the switch. The movement of the contact lever 1 is controlled by a rod assembly 4 and a driving device that is not shown in detail.

Figure 2:
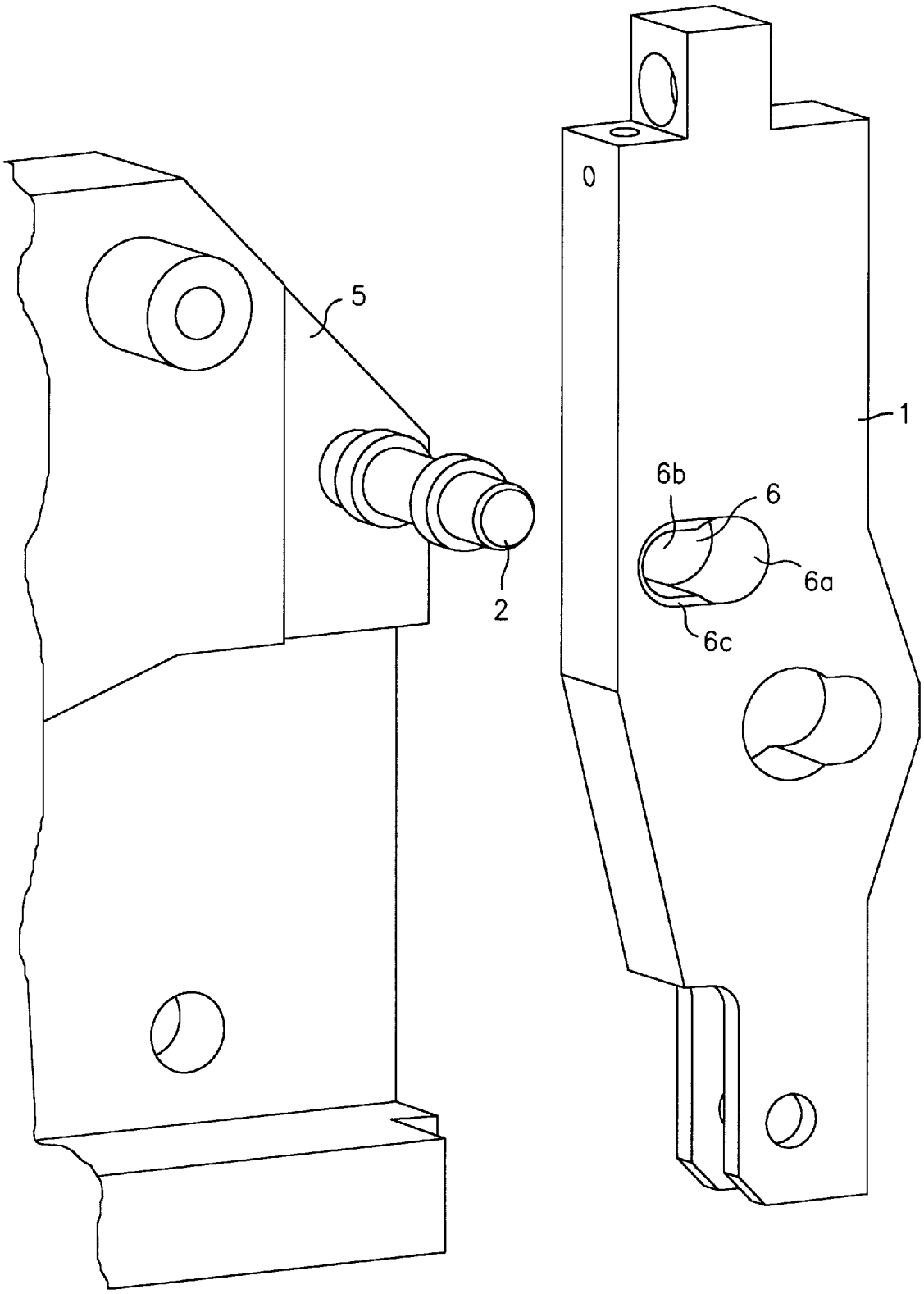
FIG. 2, a perspective view of the main elements of the switch.

The shaft 2 is—as shown in detail in FIG. 2—rigidly arranged on a mounting 5 and contains two conically extending shoulders 2*a* and 2*b* which reduce the diameter of the central section 2*c* of the shaft 2. Consequently, the central section 2*c* serves as the pivoting axis for the contact lever 1.

Figure 3A:
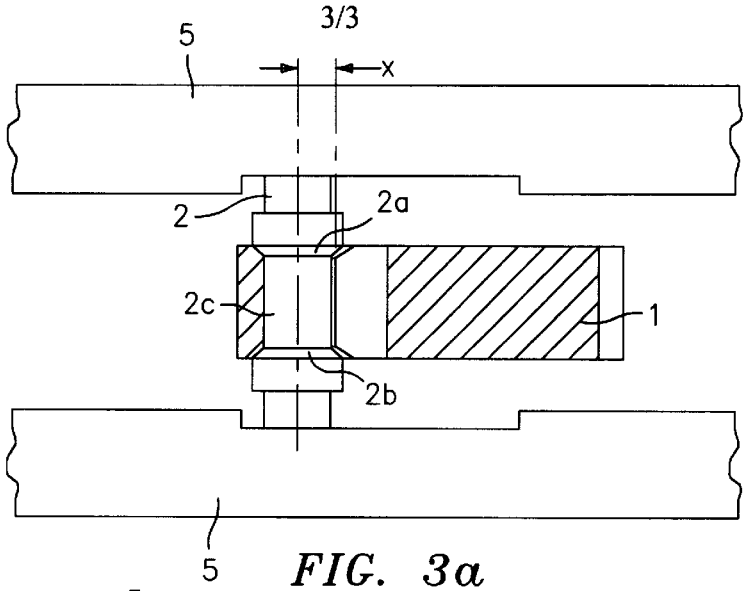
FIGS. 3*a*, 3*b*, sectional views of the contact lever shown in FIG. 2, namely sectioned along a plane that extends along the direction of the oblong hole (receptacle opening) with the shaft accommodated therein.

In the assembled state of the switch shown in FIG. 1*a*, the contact lever is arranged on the shaft 2 by means of an opening 6. To assemble, the shaft 2 is inserted in the larger first end section 6*a* of opening 6 until the contact lever is centered between the conically extending shoulders 2*a* and 2*b* of the shaft 2. In this embodiment, the opening 6 represents an oblong hole with two end sections 6*a*, 6*b*. The end sections 6*a*, 6*b* of the oblong hole 6 are realized essentially cylindrical, wherein the second end section 6*b* has a smaller diameter than the first end section 6*a*. The second end section is realized in semicircular fashion and connected to the first end section 6*a* via a straight opening section 6*c* that tangentially originates at the semicircle of the second end section 6*b* and contains walls that extend parallel to one another. The straight opening section 6*c* has the length (x) shown in FIG. 3*a*.

The edges of the opening of the second end section 6*b* and the straight opening section 6*c* are provided with chamfers 6*d*, the shape of which essentially corresponds to the shape of the conically extending shoulders 2*a* and 2*b* of the shaft 2. In this case, the central section 2*c* of the shaft 2 is longer than the width of the opposing parallel walls of the straight opening section 6*c* by 0.1–0.9 mm such that it is possible to turn the contact lever by an angle of up to 5° referred to the shaft 2 in the plane of projection of FIG. 3*b* due to the axial play of the contact lever 1 arranged on the shaft 2.

The function of the previously described elements of the switch according to the embodiment are described in detail below.

In the open state, the contact lever 1 is situated in the position shown in FIG. 1*a*. In this position, which is also further explained by the view in FIG. 3*a*, the shaft 2 is in contact with the cylindrical wall of the second end section 6*b* and carried in a sliding fashion in this second end section so as to allow a tilting or pivoting motion of the contact lever 1 which is controlled by the rod assembly 4. During the closing movement of the switch, the contact lever 1 is turned in the clockwise direction by the rod assembly 4 so as to mutually contact the main contacts 3*a* and 3*b*. After the main contacts 3*a* and 3*b* are contacted, the rotation of the contact lever 1 is continued by a small angle before the device that drives the rod assembly is adjusted. However, the end of the contact lever 1 which, relative to the shaft 2, lies on the opposite side of the rod assembly 4 is blocked by the mutually contacted main contacts 3*a* and 3*b*. This subsequent rotation serves for separating the shaft 2 from its bearing seat formed by the second end section 6*b* of the receptacle opening. In this case, the shaft 2 assumes the position in the straight opening section 6*c* which is shown in FIGS. 1*b* and 3*b*.

The previously described subsequent rotation of the contact lever 1 initially allows a slight pivoting of the main contacts 3*a* and 3*b* relative to one another in the plane of projection of FIGS. 1*a* and 1*b*. This slight pivoting serves for adjusting an optimal contact line between the main contacts 3*a* and 3*b*.

Figure 3B:
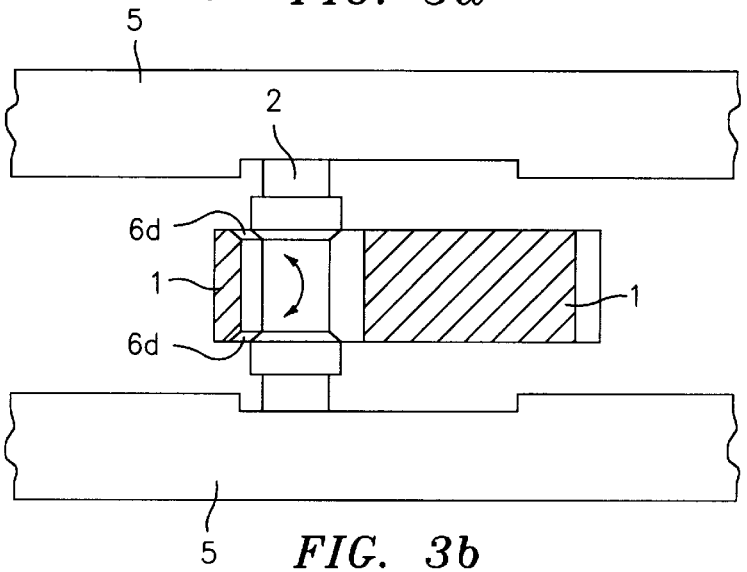
Figure 3C:
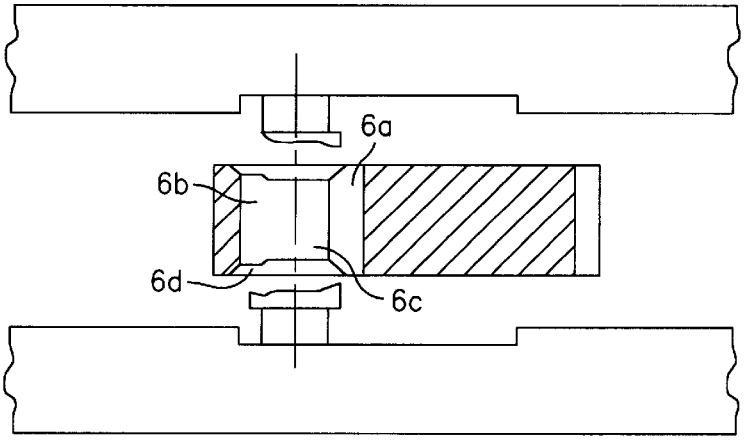
FIG. 3*c*, a view according to FIG. 3*b* which shows the central section of the shaft and helps to explain a second embodiment.

In addition, a certain free pivoting of the contact lever in the plane of projection of FIG. 3*b*, i.e., in a plane that contains the shaft 2 and extends perpendicular to the mutually contacted contact surfaces of the main contacts 3*a* and 3*b* of the contact lever 1, is ensured due to the special design of the chamfered edges of the straight opening section 6*c* and the conical shoulders of the central section 2*c* of the shaft 2. Due to the previously described construction, the displacement of the bearing point of the contact lever 1 which is engaged with the shaft 2, namely the displacement from the second end section 6*b* to the central straight opening section 6*c*, provides the additional advantage that a slight pivoting of the main contacts 3*a* and 3*b* relative to one another is possible in a plane that extends perpendicular to the plane of projection of FIGS. 1*a* and 1*b*. This causes the opposing surfaces of the main contacts 3*a* and 3*b* to automatically adjust themselves relative to one another in such a way that a contact surface of maximum size is ensured between the main contacts 3*a* and 3*b*.

In other words, the construction according to the invention ensures a freedom of motion of the contact lever such that a change in position like a ball-and-socket joint of the main contact 3*a* arranged on the contact lever 1 is possible relative to the stationary main contact 3*b*.

The invention is not limited to the previously described embodiment.

For example, the mutually adapted bearing surfaces of the shaft and the receptacle opening may also have any other combination of shapes. The rotationally symmetrical concave central section of the shaft 2 situated between the shoulders 2*a* and 2*b*, on which the contact lever 1 is arranged, may also be formed by a circular line. In this case, the walls of the second end section 6*b* which can be brought into contact with this section also need to be rounded in correspondingly circular fashion so as to ensure the largest sliding bearing surface possible. However, the radius of the curvature of the edges in the central section 6*c* of the receptacle opening 6 should be smaller than the radius of the curvature of the second section 6*b* so as to ensure sufficient play for rotating the shaft 2 within the central section.

I claim:

1. Switch, containing a contact lever, that is arranged on a shaft and provided with a first main contact, wherein the contact lever can be pivoted relative to a second main contact, wherein the pivot shaft is accommodated in a receptacle opening of the contact lever, wherein said receptacle opening contains at least a first opening section having chamfered edges that are engaged with a pair of conically extending shoulders, and wherein the receptacle opening contains a second opening section which is arranged adjacent to the first opening section and also includes chamfered edges that carry the contact lever on the pivot shaft during a pivoting motion of the contact lever which is continued after the main contacts mutually contact one another, allowing a pivoting motion of the contact lever in a plane that extends parallel to the pivot shaft.

2. Switch according to claim 1, wherein said second opening section allows said contact lever an additional controlled range of motion when said switch is in a closed position allowing said moveable and stationary contacts to automatically adjust for an optimum contact alignment.

3. A switch comprising:

a pivot shaft having a first conically extending shoulder and a second conically extending shoulder separated by a pivot shaft central section length;

a contact lever mounted on said pivot shaft;

at least one pair of contacts comprising a moveable contact attached to said contact lever and a stationary contact, wherein a contact surface is formed between said moveable contact and said stationary contact when the switch is in a closed position; and a contact lever and pivot shaft engagement surface, wherein said contact lever is centrally aligned with said stationary contact when said switch is in an open position and an additional controlled range of motion of the contact lever is provided when said switch is in a closed position allowing said moveable and stationary contacts to automatically adjust for an optimum contact alignment.

4. The switch as claimed in claim 3, wherein said contact lever has a an opening for rotatably mounting said lever on said pivot shaft between said first conically extending shoulder and said second conically extending shoulder.

5. The switch as claimed in claim 4, wherein said opening has a first end section, a second end section, and a straight portion connecting said first end section to said second end section.

6. A switch comprising:

a pivot shaft having a pair of ends, a central section, and a pivot shaft central axis; a contact lever;

a receptacle opening in said contact lever, wherein said contact lever is rotatably mounted on said pivot shaft; and a bearing surface formed between the pivot shaft and the receptacle opening, wherein said bearing surface includes at least one segment that is not parallel to said pivot shaft central axis.

7. The switch as claimed in claim 6, wherein said bearing surface includes a pair of chamfered edges of said receptacle opening and a corresponding pair of conically extending shoulders of said pivot shaft.

8. The switch as claimed in claim 6, wherein said central section of said pivot shaft is thinner than said pair of ends of said pivot shaft.

9. The switch as claimed in claim 8, wherein said pair of end sections taper down to said central section to form a concave shape when viewed from a direction perpendicular to said pivot shaft central axis.

10. The switch as claimed in claim 9, wherein said bearing surface is formed between said central section of said pivot shaft ad a receptacle opening wall having a corresponding convex shape.

* * * * *